US011268240B2

(12) United States Patent
Saikkonen et al.

(10) Patent No.: US 11,268,240 B2
(45) Date of Patent: Mar. 8, 2022

(54) YANKEE DRYING HOOD ARRANGEMENT, A YANKEE DRYING CYLINDER FITTED WITH A YANKEE DRYING HOOD ARRANGEMENT AND A METHOD OF DRYING A FIBROUS WEB

(71) Applicant: VALMET AB, Sundsvall (SE)

(72) Inventors: Olli Saikkonen, Gorizia (IT); Luca Moscatelli, Villa Vicentina (IT); Klavdij Lasic, Sempeter Pri Gorici (SI); Raffaele Malutta, Gorizia (IT); Michele Durisotti, Buja (IT); Lorenzo Simeoni, Gorizia (IT)

(73) Assignee: VALMET AB, Sundsvall (SE)

( * ) Notice: Subject to any disclaimer, the term of this patent is extended or adjusted under 35 U.S.C. 154(b) by 0 days.

(21) Appl. No.: 17/423,005

(22) PCT Filed: Jan. 15, 2020

(86) PCT No.: PCT/EP2020/050854

§ 371 (c)(1),
(2) Date: Jul. 14, 2021

(87) PCT Pub. No.: WO2020/148304

PCT Pub. Date: Jul. 23, 2020

(65) Prior Publication Data

US 2022/0042244 A1 Feb. 10, 2022

(30) Foreign Application Priority Data

Jan. 15, 2019 (SE) ..... 1950043-8

(51) Int. Cl.

| | |
|---|---|
| ***D21F 5/18*** | (2006.01) |
| ***D21F 5/02*** | (2006.01) |
| ***D21F 5/04*** | (2006.01) |

(52) U.S. Cl.
CPC ..... *D21F 5/181* (2013.01); *D21F 5/021* (2013.01); *D21F 5/044* (2013.01)

(58) Field of Classification Search
USPC ..... 162/207
See application file for complete search history.

(56) References Cited

U.S. PATENT DOCUMENTS 3,855,713 A * 12/1974 Portouw ..... D21F 5/02 34/122
5,784,804 A 7/1998 Nowakowski
(Continued)

FOREIGN PATENT DOCUMENTS

| | | | |
|---|---|---|---|
| EP | 2126203 | B1 | 6/2012 |
| EP | 2963176 | A1 | 1/2016 |
| WO | WO-99/57367 | A1 | 11/1999 |

OTHER PUBLICATIONS

International Searching Authority, International Search Report and Written Opinion for International Application No. PCT/EP2020/050854, dated Mar. 11, 2020, (10 pages), European Patent Office, Rijswijk, Netherlands.

*Primary Examiner* — Mark Halpern
(74) *Attorney, Agent, or Firm* — Alston & Bird LLP

(57) ABSTRACT

The invention relates to a Yankee drying hood arrangement (1) which has a first temperature main supply conduit (9, 9') for a fluid such as hot air, or hot air and steam and/or water vapour, at a first temperature T1 and a second temperature main supply conduits (10, 10') for a fluid such as hot air, or hot air and steam and/or water vapour, at a second temperature T2 which is not the same as T1, the first temperature and second temperature main supply conduits (9, 9', 10, 10') being in communication with the distributor conduits (8) such that a fluid such as hot air can stream from the first temperature and second temperature main supply conduits (9, 9', 10, 10') to the distributor conduits (8), wherein at least
(Continued)

one distributor conduit (8) is provided with damper means (31) for changing the ratio between amount of fluid at temperature T1 from the first temperature main conduit and the amount of fluid at temperature T2 from the second temperature main conduit that streams into the distributor conduit.

16 Claims, 11 Drawing Sheets

(56) References Cited

U.S. PATENT DOCUMENTS

| | | | | |
|---|---|---|---|---|
| 7,716,850 | B2 * | 5/2010 | Deem | D21F 5/181 34/117 |
| 9,702,084 | B2 * | 7/2017 | Saikkonen | D21F 5/181 |
| 2004/0093757 | A1 * | 5/2004 | Lamminpaa | D21G 9/0063 34/114 |
| 2008/0034606 | A1 * | 2/2008 | Deem | D21F 5/044 34/115 |

* cited by examiner

WE

DE

YANKEE DRYING HOOD ARRANGEMENT, A YANKEE DRYING CYLINDER FITTED WITH A YANKEE DRYING HOOD ARRANGEMENT AND A METHOD OF DRYING A FIBROUS WEB

CROSS REFERENCE TO RELATED APPLICATIONS

This application is a National Stage Application, filed under 35 U.S.C. § 371, of International Application No. PCT/EP2020/050854, filed Jan. 15, 2020, which international application claims priority to and the benefit of Sweden Application No. 1950043-8, filed Jan. 15, 2019; the contents of both of which as are hereby incorporated by reference in their entireties.

BACKGROUND

Related Field

The invention relates to a Yankee drying hood arrangement and a Yankee drying cylinder fitted with a Yankee drying hood arrangement. The invention also relates to a method of drying a fibrous web using such a Yankee drying hood arrangement.

Description of Related Art

Yankee drying cylinders are often equipped with a Yankee hood to increase the drying effect. The Yankee hood typically has a drying fluid, typically air, supply system for supplying air that is blown against the paper web as the paper web travels over the cylindrical surface of the Yankee cylinder. The supplied air heated so it can aid evaporation of the water that is present in the paper web. A common design of a Yankee hood comprises an enclosure, i.e. a box structure. One or several major air supply conduits are arranged to transport heated air to the enclosure. Inside the enclosure, distributor conduits connected to the major air supply conduits allow the heated air to be sent to nozzle boxes that are distributed around the Yankee drying cylinder and extend in the axial direction of the Yankee drying cylinder. The nozzle boxes form a curved structure around the periphery of the Yankee drying cylinder and they have openings facing the Yankee drying cylinder through which heated air can be sent towards the outer surface of the Yankee drying cylinder and thereby also against the paper web. An example of a Yankee hood system is disclosed in, for example, U.S. Pat. No. 5,784,804. A known way of arranging the distributor conduits is to place several such distributor conduits in parallel and let them follow the outer circumference of the curved structure formed by the nozzle boxes. The heating of the air may occur before the air is sent into the enclosure of the Yankee hood, but heating may also be arranged inside the enclosure. The heating of the web caused by the hot air coming through the nozzle boxes may sometimes vary in the cross-machine direction (the CD direction). This may in turn result in undesirable variations in dryness of the paper web across the width of the paper web, i.e. a moisture profile that is less even than what is desired. To find good solutions to this problem has become more and more important. While a certain variation in the CD moisture profile could be accepted in the past, current standards require more uniform performance and less variation in moisture profile. In EP2963176 a Yankee drying hood is provided with a plurality of nozzle boxes that are distributed around an imaginary axis such that, when the Yankee drying hood arrangement is fitted over a Yankee drying cylinder, the nozzle boxes are spaced from the circular cylindrical surface but form a curved structure that follows the outer contour of the circular cylindrical surface of the Yankee drying cylinder. Through openings in the nozzle box a fluid such as hot air can exit the nozzle boxes and stream towards the circular cylindrical surface of the Yankee drying cylinder at different points along the longitudinal extension of each nozzle box. Thereby, the fluid streaming from the openings can reach the circular cylindrical surface of the Yankee drying cylinder at different points along the axial extension of the Yankee drying cylinder. There are distributor conduits which extend in the circumferential direction around the curved structure formed by the nozzle boxes and each distributor conduit is in communication with several different nozzle boxes such that a fluid can stream from each distributor conduit to several nozzle boxes. Dampers are provided in some or all of the distributor conduits and may advantageously be connected to control equipment such as a computer that controls opening or closing of the damper(s) for example in response to measurements of dryness profile made on the web that exits the Yankee drying cylinder. Partly closing a damper reduces the flow of hot air to the nozzle box downstream of the damper and thus reduces the drying taking place. However, restricting the fluid flowing in one distributer conduit by closing one damper causes an increase in the fluid flow in other conduits—thereby causing changes in the dryness profile in the web served by those conduits. This may cause another damper to partly close—thus causing further changes to the dryness profile in other parts of the web. Practically experience shows that during use the control systems tend to close dampers but not reopen them when conditions change. Over time more and more dampers close, thereby increasing the resistance to fluid flow in the system. This requires more power from the fans which move the fluid in the distribution conduits and wastes energy. The object of the present invention is to provide an improved Yankee drying hood arrangement that is capable of achieving more even heating in the cross-machine direction and thereby an improved moisture profile with less energy use.

BRIEF SUMMARY

The object of the invention is achieved by the inventive Yankee drying hood arrangement. The Yankee drying hood of the present invention is shaped to be fitted over (placed over) a Yankee drying cylinder that has an axial extension and a circular cylindrical surface such that the drying hood arrangement can cover a part of the circular cylindrical surface of the Yankee drying cylinder. The inventive Yankee drying hood arrangement comprises a plurality of nozzle boxes distributed around an imaginary axis such that, when the Yankee drying hood arrangement is fitted over a Yankee drying cylinder, the nozzle boxes are spaced from the circular cylindrical surface but form a curved structure that follows the outer contour of the circular cylindrical surface of the Yankee drying cylinder. Each nozzle box has a longitudinal extension in a direction parallel to the axial extension of the Yankee drying cylinder and each nozzle box has a plurality of openings distributed along the longitudinal extension of the nozzle box. Through the openings in the nozzle box, a fluid such as hot air can exit the nozzle boxes and stream towards the circular cylindrical surface of the Yankee drying cylinder at different points along the longitudinal extension of each nozzle box. Thereby, the fluid streaming from the openings can reach the circular cylindrical surface of the Yankee drying cylinder at different points along the axial extension of the Yankee drying cylinder. The inventive Yankee drying hood arrangement further comprises a plurality of distributor conduits for a fluid such as hot air. The distributor conduits extend in the circumferential direction around the curved structure formed by the nozzle boxes and each distributor conduit is preferably in communication with several different nozzle boxes such that a fluid such as hot air can stream from each distributor conduit to several nozzle boxes. The Yankee drying hood arrangement also comprises at least two main supply conduits for fluids such as dry hot air, moist hot air, steam or the like. A first temperature main supply conduit supplies fluid at a first temperature T1 and a second temperature main supply conduit supplies fluid at a second temperature T2 which is not the same as the first temperature. The first and second main supply conduits are in common communication with one or more of the distributor conduits such that fluids can stream from both the first temperature and second temperature main supply conduits to the one or more distribution conduits and can be combined in preferably variable ratios before and/or at inlets to the one or more distributor conduits and/or inside said one or more distribution conduits, to provide a mixed fluid at an intermediate temperature between the first temperature and the second temperature which mixed fluid with an intermediate temperature which is between said first and second temperature can then stream to the nozzle box(es) which are in fluid communication with the one or more distribution conduits, thereby allowing the drying effect on the web of the nozzle boxes to be varied. According to the invention, damper means are provided at the inlets to the distributor conduits so that the proportion of fluid from the first main supply conduit and the second main supply conduit can be varied, thereby changing the intermediate temperature of the fluid while maintaining substantially the same total flow rate of fluid. The damper means each are preferably in the form of a flap or disk which can be rotated or slide or deflected or likewise maneuvered in order to reduce the fluid flow from one of the main supply conduits connected to a distribution conduit by a certain amount while increasing the fluid flow from the other main supply conduit connected to the same distribution conduit by the same amount thereby maintaining substantially the same total flow. This means that no addition power is needed to drive the fans in the system when a damper position changes and furthermore ensures that a change in damper position in one distribution conduit does not influence the flow in other distribution conduits. In preferred embodiments of the invention, the Yankee drying hood arrangement has at least two pairs of first temperature main supply conduits and second temperature main supply conduits—one pair for the "wet end" (described in more detail below) of the Yankee drying hood and one pair for the "dry end" of the Yankee drying hood and one pair for the "dry end" of the Yankee drying hood—and each pair of first and second main supply conduits may be interconnected to its own set of distributor conduits. It is also possible in other embodiments of the invention that a Yankee drying hood is only provided with first and second temperature conduits at the wet end of the Yankee drying hood or with first and second temperature conduits at the dry end of the Yankee drying hood. While the invention has been described with respect to Yankee drying hoods, it is also applicable to other types of web drying arrangements.

The nozzle boxes are preferably spaced apart from each other in the circumferential direction of the curved structure formed by the nozzle boxes such that a fluid such as air or a mixture of air and steam can pass between the nozzle boxes. Preferably, the nozzle boxes are spaced from each other by a distance of 30 mm-70 mm in the circumferential direction of the curved structure formed by the nozzle boxes.

Preferably, an evacuation conduit is arranged to evacuate exhaust fluid such as air or a mixture of air and steam from the Yankee drying hood arrangement and the evacuation conduit is preferably in fluid connection with the one or more of the main conduit(s) so that some of the exhaust fluid can be recycled and thereby the heat energy in the recycled exhaust fluid reused. It is also possible for the evacuation conduit be in fluid connection with an exhaust conduit leading to atmosphere and/or a heat recover system or the like, so that some of the exhaust fluid can be reused in the Yankee drying hood and some of the exhaust fluid can be withdrawn from the Yankee drying hood to allow fresh air to enter the system, thereby reducing the humidity of the hot fluid circulating in the system.

In all embodiments of the invention, each opening in the nozzle boxes may have a diameter in the range of 2 mm-10 mm, preferably 3 mm-7 mm but other numerical values are also conceivable.

In all embodiments of the invention, the Yankee drying hood arrangement may be arranged in such a way that, in the circumferential direction of the curved structure formed by the nozzle boxes, the Yankee drying hood arrangement is divided into a first part and a second part. The first part may have, for example, 2-4 distributor conduits per meter width of the curved structure where the width of the structure is measured in the direction of the imaginary axis around which the nozzle boxes are distributed. The second part may have fewer distributor conduits per meter width of the curved structure. For example, the second part may have 1-2 distributor conduits per meter width of the curved structure. In such embodiments, the first part and the second part of the Yankee drying hood arrangement may have the same extension in the circumferential direction of the curved structure. The first part and the second part usually have the same number of nozzle boxes. However, embodiments are possible in which there is actually a larger number of nozzle boxes in one of the two parts than in the other. The first part may have a larger wrap angle over the Yankee drying cylinder than the second part but it may also be so that the second part has a larger wrap angle over the Yankee drying cylinder than the first part—or both the first and the second part may have the same wrap angle over the Yankee drying cylinder (i.e. they have the same length/extension in the circumferential direction). The invention also relates to a Yankee drying cylinder which has been fitted with the inventive Yankee drying hood arrangement. The Yankee drying cylinder is rotatably journaled such that it can rotate about an axis of rotation which coincides with the imaginary axis around which the nozzle boxes are distributed such that the nozzle boxes extend along the outer cylindrical surface of the Yankee drying cylinder and can deliver hot fluid towards the outer cylindrical surface of the Yankee drying cylinder along the axial extension of the Yankee drying cylinder.

DETAILED DESCRIPTION OF VARIOUS EMBODIMENTS

Figure 1:
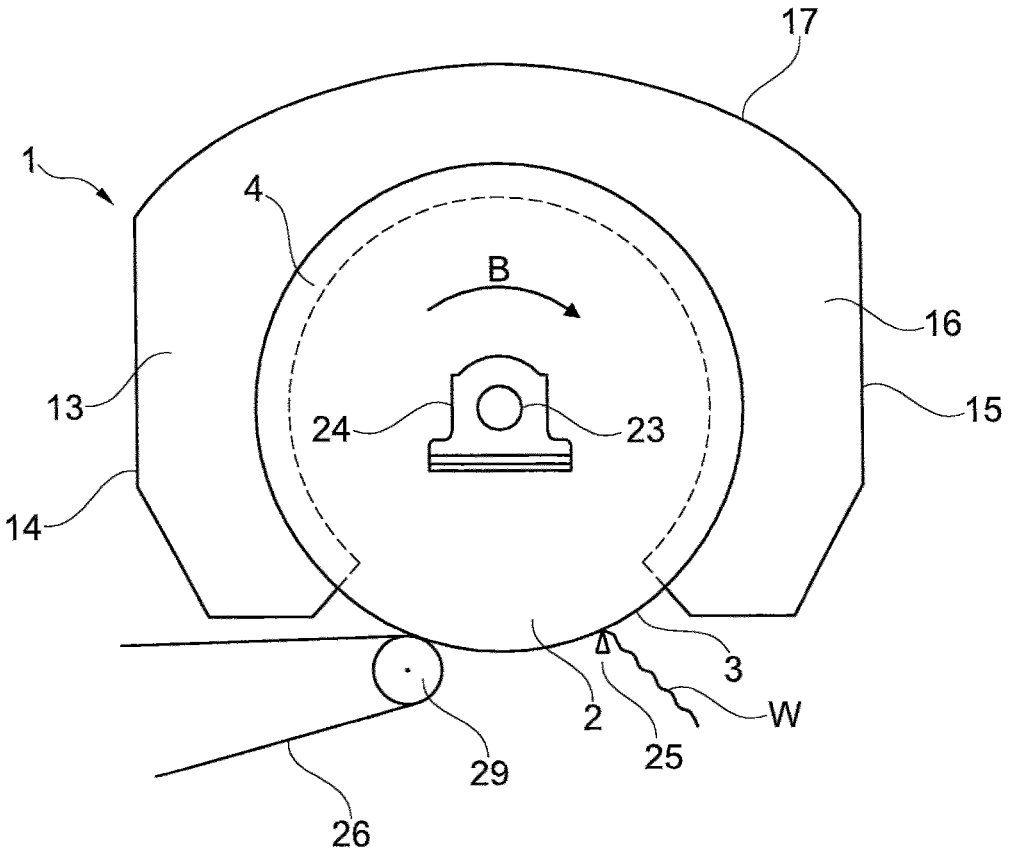
FIG. 1 is a schematic representation of a Yankee drying cylinder which is fitted with a Yankee drying hood according to the invention.
Figure 2:
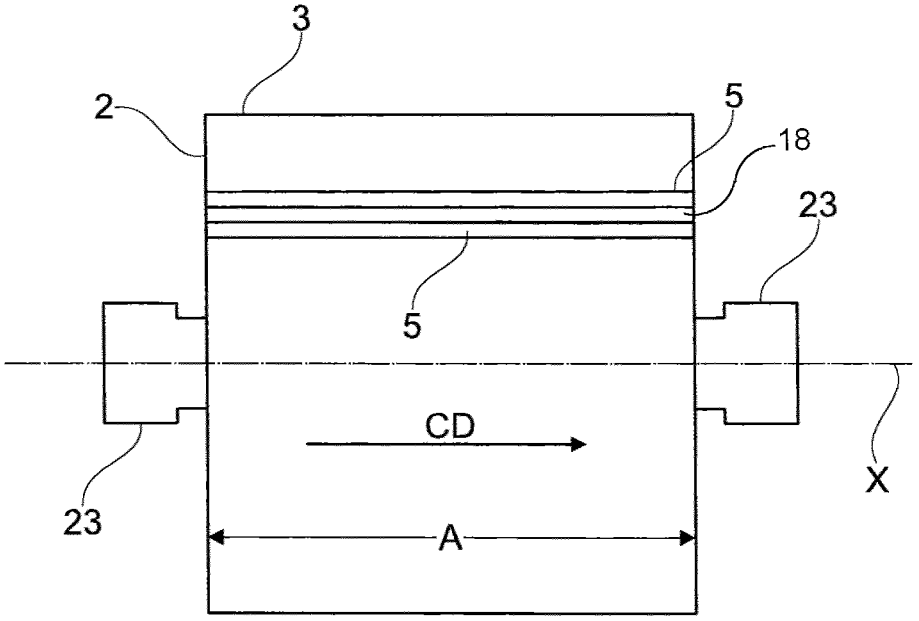
FIG. 2 is a schematic representation of the Yankee drying cylinder of FIG. 1 showing the Yankee drying cylinder along its axial extension.

With reference to FIG. 1, a rotatable Yankee drying cylinder 2 is shown. The Yankee drying cylinder is arranged to dry a wet fibrous web W that is coming from a forming section (not shown) carried by a fabric 26 which may be a fabric used in the forming section. The fabric 26 may be, for example, a felt or an impermeable band. The fabric 26 may, for example, be a fabric which is also used as a forming fabric. A roll 29 within the loop of the fabric 26 may form a press nip and/or a transfer nip with the Yankee drying cylinder 2. The roll 29 may be, for example, a suction roll, a solid roll, a deflection compensated roll or an extended nip roll such as a shoe roll. Such arrangements for carrying the fibrous web to the Yankee drying cylinder 2 are known as such in the art of paper making and are described in greater detail. The exact method used for carrying the fibrous web W to the Yankee drying cylinder does not form a part of the present invention but is included only to further clarify the overall context of the invention. The Yankee drying cylinder can take many different forms. For example, the Yankee drying cylinder 2 may be a cast iron Yankee cylinder or a Yankee drying cylinder of welded steel as disclosed in for example European patent No. 2126203. In principle, the fibrous web W may be any kind of fibrous web W such as a paper web or a board web but it may in particular be a tissue paper web. The present invention may be used at least for tissue paper webs, for example webs W that are intended for toilet paper, facial towel, kitchen towel or the like. Such tissue paper grades may often have a basis weigh in the range 10 g/m$^2$-50 g/m$^2$ although basis weight values outside this range may also be conceivable. Very often, basis weigh may lie in the range of 15 g/m$^2$-30 g/m$^2$. The Yankee drying cylinder 2 is heated such that water in the fibrous web W will evaporate when the fibrous web passes over the external surface 3 of the Yankee drying cylinder 2. The surface of the Yankee drying cylinder is cylindrical and the Yankee drying cylinder 2 is normally heated from the inside by hot steam which is fed into the Yankee drying cylinder in ways that are well known to those skilled in the art. When the steam inside the Yankee drying cylinder 2 condensates, the heat energy is transferred to the circular cylindrical surface 3 of the Yankee drying cylinder such that water in web W that travels over the Yankee drying cylinder 2 is evaporated. In FIG. 1, the direction of rotation of the Yankee drying cylinder 2 is indicated by the arrow B as being "clockwise". With further reference to FIG. 1, the finally dried web W can be taken off the Yankee drying cylinder 2 by a device such as, for example, a doctor blade 25 as is known in the art. The fibrous web W may then be taken to a reel-up as is known in the art. The design of the reel-up and the way in which the fibrous web W is brought to the reel-up do not form a part of the present invention but the reel-up is mentioned to further clarify the overall context of the invention. The Yankee drying cylinder 2 is normally rotatably journaled in bearings 24 in which journals 23 of the Yankee drying cylinder 2 permit rotation of the Yankee drying cylinder about an axis of rotation X (see FIG. 2). It should be understood that the bearings 24 are supported by a supporting structure (not showed). The Yankee drying cylinder 2 is shown in FIG. 2 along its axial extension, i.e. the cross-machine direction which is indicated by CD in FIG. 2. As can be seen in FIG. 2, the Yankee drying cylinder has a cylindrical outer surface 3 and an axial extension/length A and it can rotate about its axis of rotation X during operation. In FIG. 2, two nozzle boxes 5, separated by a gap 18, are also shown. It should be understood that the inventive Yankee drying hood arrangement normally comprises more than just two nozzle boxes 5 and the inclusion of the two nozzle boxes 5 in FIG. 2 only serve to illustrate that the nozzle boxes 5 have a longitudinal extension/length that substantially corresponds to the axial extension A of the Yankee drying cylinder 2.

Figure 6:
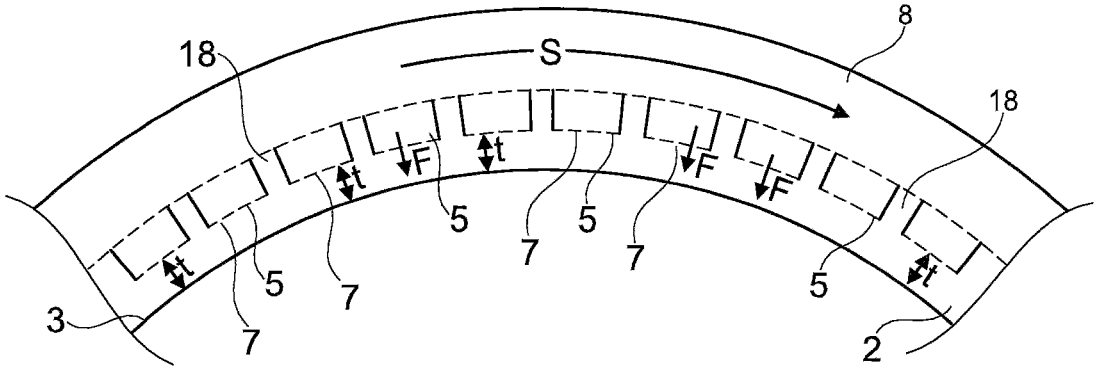
FIG. 6 is a schematic representation of some of the nozzle boxes seen from the side that will face the cylindrical surface of the Yankee drying cylinder when the Yankee drying hood arrangement is mounted on the Yankee drying cylinder.
Figure 12:
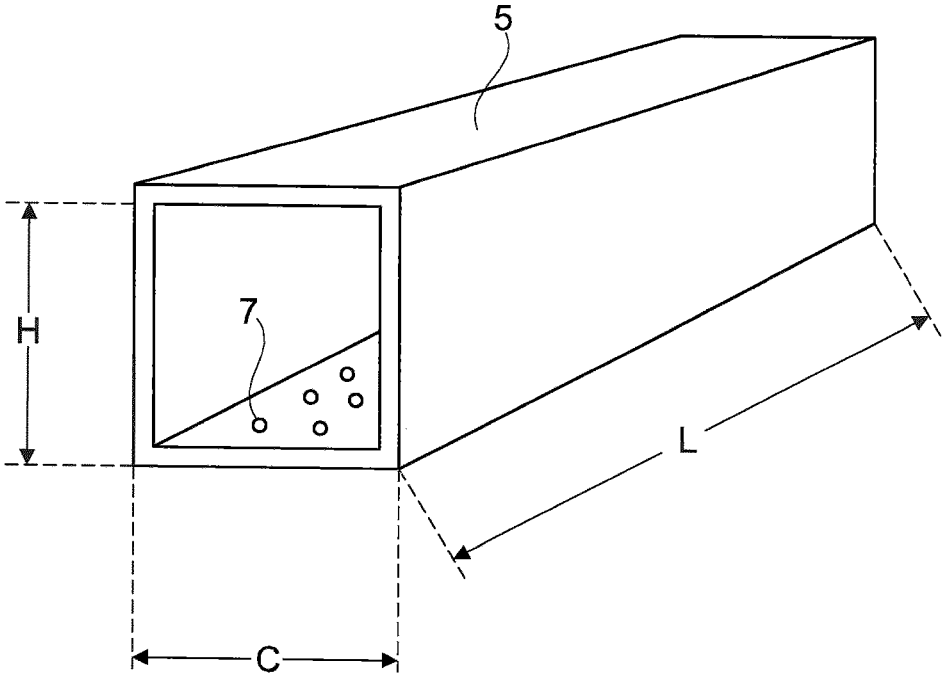
FIG. 12 is a perspective view of a nozzle box.

The Yankee drying hood arrangement 1 is shaped to be fitted over a Yankee drying cylinder 2 such that the drying hood arrangement 1 can cover a part 4 of the circular cylindrical surface 3 of the Yankee drying cylinder 2. In FIG. 1, the part 4 of the Yankee drying cylinder 2 which for the moment is covered by the Yankee drying hood arrangement 1 is indicated by a broken line. Of course, as the Yankee drying cylinder 2 rotates during operation, different parts 4 will be covered at different points in time. With reference to FIG. 2, FIG. 3, FIG. 4 and FIG. 6, the Yankee drying hood arrangement 1 comprises a plurality of nozzle boxes 5 distributed around an imaginary axis X such that, when the Yankee drying hood arrangement 1 is fitted over the Yankee drying cylinder 2, the nozzle boxes 5 are spaced from the circular cylindrical surface 3 of the Yankee drying cylinder 2 but form a curved structure 6 that follows the outer contour of the circular cylindrical surface 3 of the Yankee drying cylinder 2. In practice, the imaginary axis X will coincide with or substantially coincide with (i.e. will be parallel to) the axis of rotation X of the Yankee drying cylinder 2 such that, for practical purposes, the imaginary axis X and the axis of rotation can be regarded as the same axis X when the Yankee drying hood arrangement 1 is mounted on the Yankee drying cylinder 2 and the Yankee drying cylinder 2 and Yankee drying hood arrangement 1 are ready for use. With reference to FIG. 4, the nozzle boxes 5 are preferably equidistantly distributed around the imaginary axis X such that they all are substantially concentric to the imaginary axis X and the nozzle boxes 5 together form the curved structure 6 which is centered around the imaginary axis X. Thereby, the distance "t" (see FIG. 6) from a nozzle box 5 to the circular cylindrical surface 3 will be substantially the same for all nozzle boxes 5. In all embodiments of the invention, the nozzle boxes 5 may be distributed around the imaginary axis X such that they are equidistantly or substantially equidistantly spaced from the imaginary axis X but embodiments are conceivable in which at least one of the nozzle boxes 5 is slightly closer to the imaginary axis X than other nozzle boxes 5 such that, when the Yankee drying hood arrangement is fitted over a Yankee drying cylinder 2, the distance "t" from at least one nozzle box 5 to the circular cylindrical surface 3 of the Yankee drying cylinder 2 is somewhat smaller than or somewhat larger than the distance "t" is for the other nozzle boxes 5. When the Yankee drying hood arrangement 1 is fitted on a Yankee drying cylinder 2, the imaginary axis X will coincide with or substantially coincide with the axis of rotation X of the Yankee drying cylinder 2. As can be seen in FIG. 2, the nozzle boxes 5 have a longitudinal extension/length in a direction parallel to the axial extension/length A of the Yankee drying cylinder 2 when the Yankee drying hood arrangement is fitted on the Yankee drying cylinder (see also FIG. 12 in which the longitudinal extension of a nozzle box is indicated by the symbol "L"). In preferred embodiments, the nozzle boxes 5 have a longitudinal extension/length that is sufficient to cover the entire axial extension/length A of the Yankee drying cylinder or at least substantially the entire axial extension/length A of the Yankee drying cylinder 2 (as indicated in FIG. 2). In preferred embodiments of the invention the longitudinal ends of the nozzle boxes 5 lie in the same plane. It will be understood that the curved structure 6 which is formed by the nozzle boxes 5 also has a longitudinal extension in the same direction as the longitudinal extension of the nozzle boxes 5. With further reference to FIG. 6, and FIG. 12, each nozzle box 5 has a plurality of openings 7 distributed along the longitudinal extension L of the nozzle box 5 (see FIG. 12) through which openings 7 a fluid such as hot air can exit the nozzle boxes 5 and stream towards the circular cylindrical surface 3 of the Yankee drying cylinder 2 at different points along the longitudinal extension L of each nozzle box 5 such that the fluid streaming from the openings 7 can reach the circular cylindrical surface 3 of the Yankee drying cylinder 2 at different points along the axial extension/length A of the Yankee drying cylinder 2.

Figure 10:
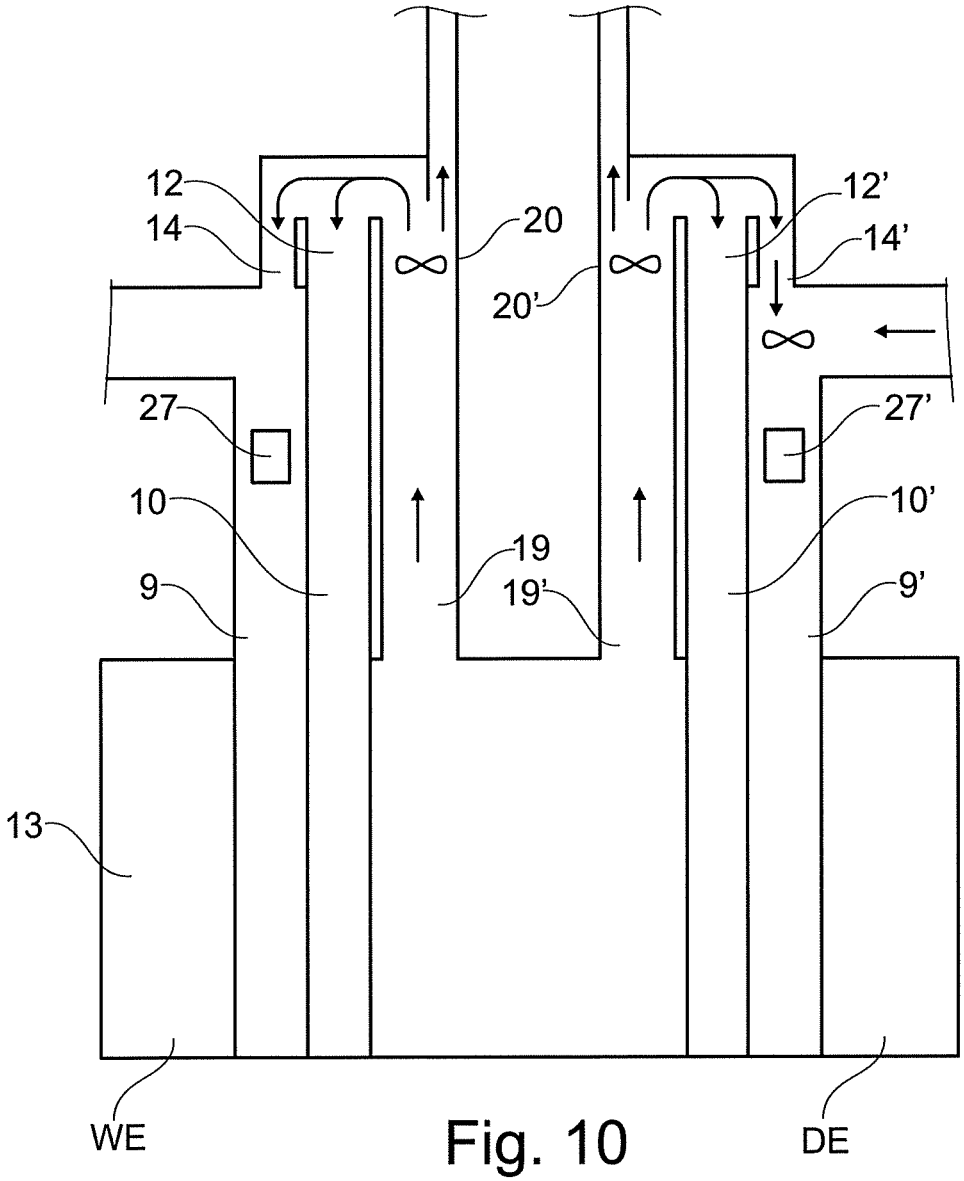
FIG. 10 is a schematic representation of the system for supplying and evacuating a fluid such as hot air to and from the Yankee drying hood arrangement.

With reference to FIG. 10, it can be seen how heaters 27, 27' (for example burners or electrical heaters) are arranged in the fluid supply system leading to first temperature main supply conduits 9, 9', and fans or equivalent elements 20, 20' are arranged to blow the hot fluid (in particular hot air, gas or a mixture of hot air and other hot gases) into the first temperature main supply conduit(s) 9, 9'. It should be understood that embodiments with only one first temperature main supply conduit 9 are conceivable.

Preferably the heaters 27, 27' are arranged to heat the fluid in the first temperature main supply conduit to a temperature T1, (measured at a predefined position such as a predetermined distance down the conduit after the heater) which is equal to or greater than 250° C. and less than or equal to 700° C., more preferably equal to or greater than 300° C. and less than or equal to 600° C., even more preferably equal to or greater than 350° C. and less than or equal to 550° C. and most preferably equal to or greater than 400° C. and less than or equal to 525° C. FIG. 10 also shows how second temperature main conduits 10, 10' are arranged partly beside the first temperature main conduits 9 and exhaust fluid in an evacuation conduit 19, 19' from the Yankee hood is in fluid communication with the inlet ends 12, 12' of the second temperature main conduits 10, 10' and the inlet ends 14, 14' of the first temperature main conduits 9, 9'. In this way some of the exhaust fluid can be recycled in both the first temperature and second main temperature main conduits, thereby reducing the waste of energy.

The fluid in the second temperature main supply conduit has a temperature T2 (measured at a predefined position, for example the entrance to the conduit, or the end of the conduit, the middle of the conduit or the same predetermined distance along the conduit as the measurement position for the fluid in the first temperature main conduit) which preferably is equal to, or greater than, 50° C. lower than that of the fluid in the first temperature main supply conduit, more preferably equal to, or greater than, 100° C. lower than that of the fluid in the first temperature main supply conduit, even more preferably equal to, or greater than, 150° C. lower than that of the fluid in the first temperature main supply conduit, even most preferably equal to, or greater than, 200° C. lower than that of the fluid in the first temperature main supply conduit in order to allow a large range of intermediate temperatures to be achieved when fluid from the first temperature and second temperature main supply conduits are combined, as describe in below. For example, the fluid in the first temperature main supply conduit could be at 600° C. while the fluid in the second temperature main supply conduit could be at 400° C. or even lower, for example 350°.

Figure 3:
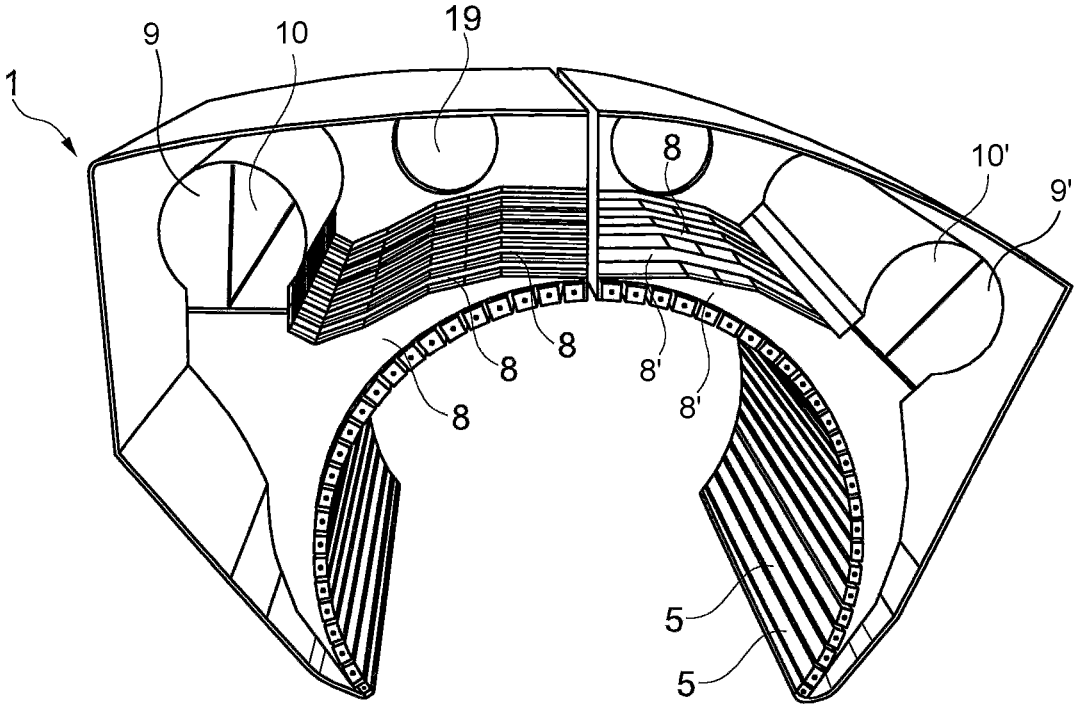
FIG. 3 is a perspective view that shows parts of the inventive Yankee drying hood arrangement.
Figure 4:
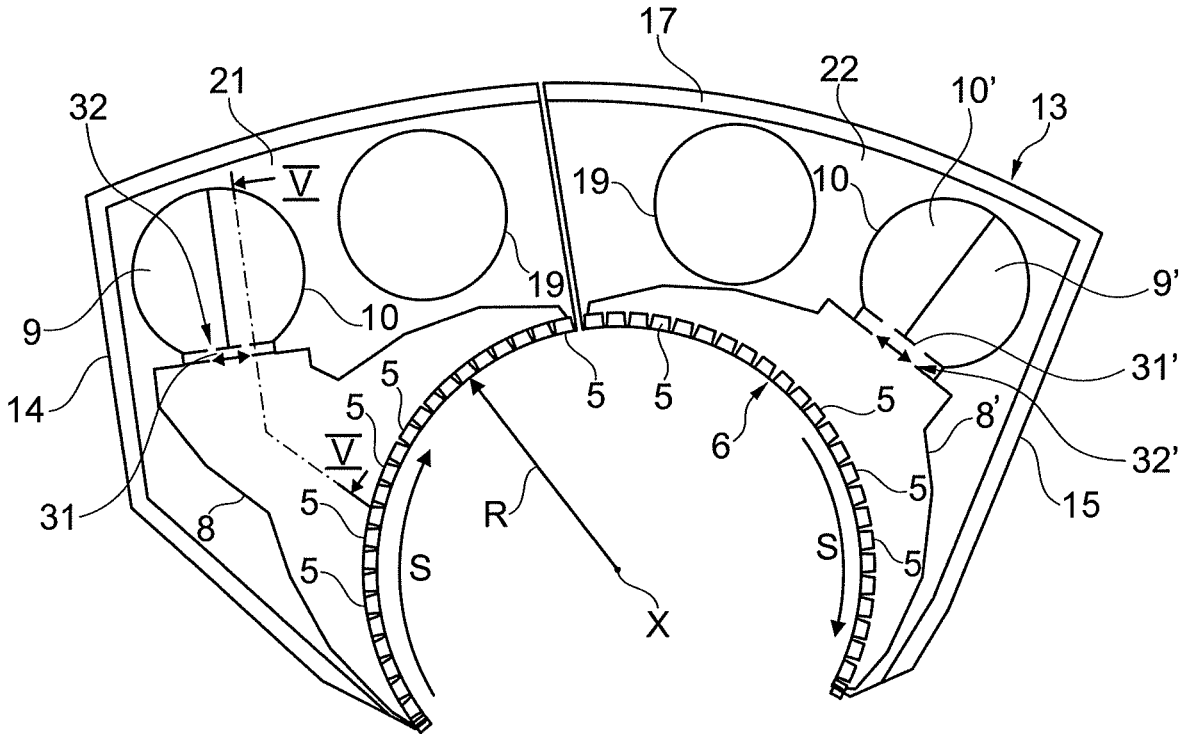
FIG. 4 is a cross-sectional side view of the inventive Yankee hood drying arrangement.
Figure 5:
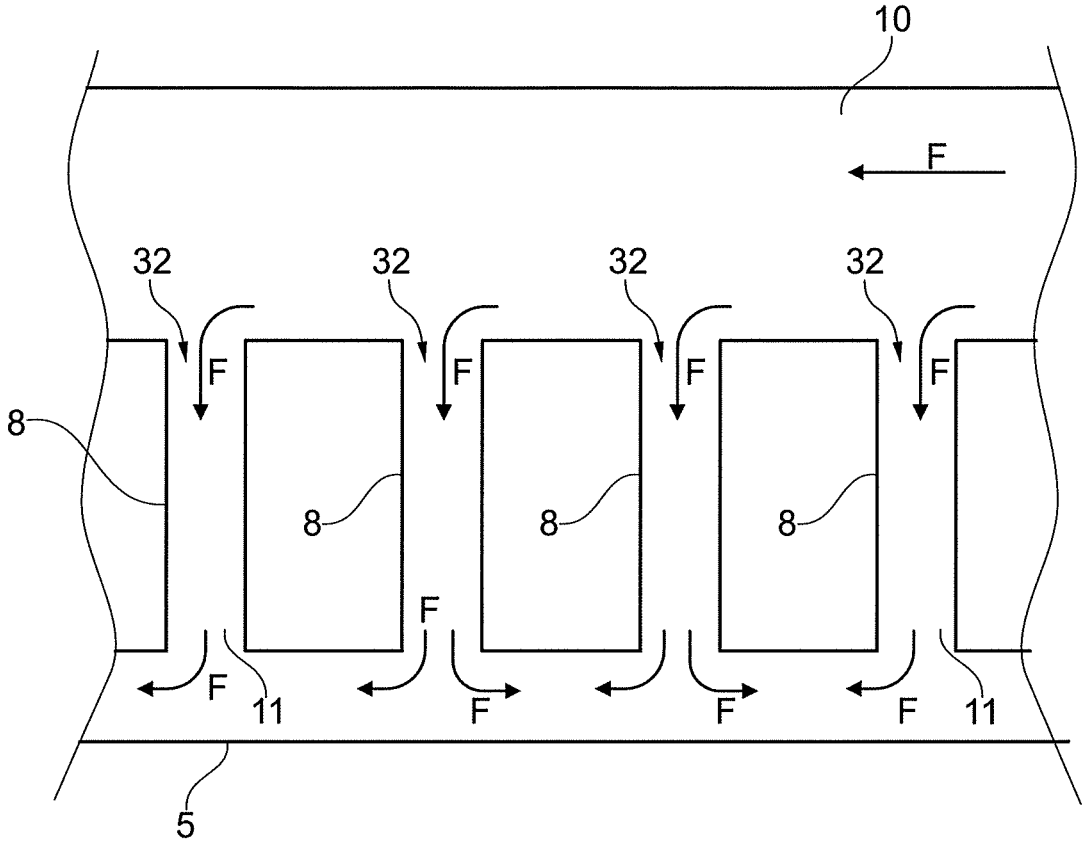
FIG. 5 is a schematic representation along line V-V in FIG. 4 which shows how a fluid such as hot air may flow from a first main supply conduit via distributor conduits to a nozzle box.

With reference to FIG. 3, FIG. 4, FIG. 5 and FIG. 6, it can be seen how a stream F of hot gases (e.g. air) can come through the first temperature and second temperature main supply conduit(s) 9, 10 and be combined to form a stream of fluid at an intermediate temperature as it enters via openings/entry points 32 into the distributor conduits 8 (see the section shown FIG. 5). From the distributor conduits 8, the stream F of hot gases at the intermediate temperature pass through communication points (openings) 11 into a nozzle box 5. With reference to FIG. 6, it can then be seen how hot fluid F streams out of the nozzle boxes 5 through the openings 7 and towards the cylindrical surface 3 of the Yankee drying cylinder 2 and thereby also towards the fibrous web W that travels on the surface of the cylindrical surface 3 (the fibrous web W is not shown in FIG. 3). It will be noted (see FIG. 6) that the openings 7 in the nozzle boxes 5 are facing the circular cylindrical surface 3 of the Yankee drying cylinder 2. The nozzle boxes 5 are normally spaced from the cylindrical surface 3 of the Yankee drying cylinder 2 by a distance "t" which preferably is equal to or greater than 15 mm and equal to or less than 50 mm but other numerical values are also possible. Generally, it is desirable that the distance "t" between the nozzle boxes 5 and the cylindrical surface 3 should be small since a smaller distance "t" tends to increase the drying effect. In theory, the distance "t" should be as small as possible to achieve the best possible drying effect. However, since the temperature of the Yankee drying hood arrangement will normally reach a level of several hundred degrees centigrade, it must be taken into account that deformation of the arrangement may occur due to the expansion of heated components. For safety reasons, i.e. in order to ensure that the Yankee drying hood arrangement will not come into direct contact with the Yankee drying cylinder when heated, the distance "t" must therefore have a certain minimum value. In many practical embodiments, the minimum value for the distance t may be 15 mm In order to get maximum drying effect, the distance "t" is preferably the same for all nozzle boxes. With reference to FIG. 3 FIG. 6, FIG. 7 and FIG. 8, it can be seen how the one and the same distributor conduit 8 communicates with several nozzle boxes 5 such that several different nozzle boxes 5 are supplied with hot fluid from the same distributor conduit 8. With reference to FIG. 3, FIG. 7, FIG. 8 and FIG. 9, it can be seen that there is a plurality of distributor conduits 8 and it can be seen how the distributor conduits 8 extend in the circumferential direction S such that nozzle boxes 5 along different positions along the circumference of the curved structure 6 can be supplied with a hot fluid F (such as hot air). Thereby, hot fluid F (such as hot air) can reach the fibrous web W at different locations along the circumference of the Yankee drying cylinder 2. It may be noted that, in FIG. 4 and FIG. 6, the circumferential direction of the curved structure is indicated with the arrow "S" which has a direction that coincides with the machine direction, i.e. the direction in which the fibrous web is moving over the Yankee drying cylinder 2. With reference to FIG. 6, it can also be seen how there is a distance "t" that separates the nozzle boxes 5 from the surface 3 of the Yankee drying cylinder 2. Embodiments are conceivable in which the distance "t" is not identical for all nozzle boxes 5.

With reference to FIG. 3 and FIG. 4, it may be noted that the distributor conduits have a larger dimension (i.e. a greater extension in the radial direction away from the imaginary axis X) in the area where they are connected to the main supply conduit(s) 9, 10 and become narrower further away from the area in which they first receive hot fluid (such as air). This is because the amount of hot fluid (e.g. hot air or gas) supplied to nozzle boxes should preferably be the same or substantially the same to all nozzle boxes 5 in order to achieve a uniform drying effect. As the hot fluid moves in the distributor conduits 8 away from the area where the first receive hot fluid from the main supply conduit(s) 9, 10, hot fluid F leaves the distributor conduits 8 and the volume of the flow in the distributor conduit gradually decreases. To achieve a substantially equal flow of hot fluid F to each nozzle box 5, the distributor conduits are suitably (but not necessarily) made narrower at their ends. While patent drawings such as FIG. 4 are normally to be understood as schematic, the part of FIG. 4 that shows how the distributor conduits 8 become narrower at their respective ends can be interpreted as an example of a realistic embodiment.

In an embodiment of the present invention, the orientation of the distributor conduits 8 in the cross-machine direction CD may be changed. Conventionally, the distributor conduits are arranged such that they simply follow the machine direction and are thus oriented at 90° to the nozzle boxes 5 (and thereby also at an angle of 90° to the imaginary axis X around which the drying nozzles are distributed). However, the distributor conduits 8 may instead be oriented around the curved structure 6 of the nozzle boxes 5 in such a pattern that, when one and the same distributor conduit 8 communicates with different nozzle boxes 5, it does so at different points along the longitudinal extension L of the different nozzle boxes 5, i.e. at points separated from each other not only in the circumferential direction of the curved structure 6 but separated from each other (spaced apart from each other) also in the direction of the longitudinal extension of the curved structure and thereby also separated from each other in the direction of the axial extension/length A of the Yankee drying cylinder 2 (the cross machine direction CD) when the Yankee drying hood arrangement 1 is fitted over a Yankee drying cylinder 2. In other words, when a distributor conduit 8 communicates with a first nozzle box 5 and a second nozzle box 5 which is separated from the first nozzle box 5 in the circumferential direction of the curved structure 6, the distributor conduit 8 will do this at points spaced apart from each other in the direction of the longitudinal extension of the nozzle boxes 5. As a consequence, a part of the cylindrical surface 3 of the Yankee drying cylinder 2 (and a corresponding part of the fibrous web W) that passes one nozzle box 5 and is exposed to hot air having a slightly varying temperature profile in the cross machine direction will then pass a following nozzle box 5 and be exposed to hot air which likewise has a slightly varying temperature profile but which is displaced in the CD direction (the direction in which the nozzle boxes 5 have their longitudinal extension) such that a part of the cylindrical surface 3 (and the fibrous web Won it) that is exposed to (relatively) less hot air as it passes one nozzle box 5 will be exposed to (relatively) hotter air as it passes a following nozzle box 5.

One way of achieving this result could be to arrange the distributor conduits 8 such that they follow a meandering or zig-zag path around the curved structure 6 formed by the nozzle boxes 5.

Alternatively, the distributor conduits 8 may be helically oriented around the curved structure 6 formed by the nozzle boxes 5.

Figure 7:
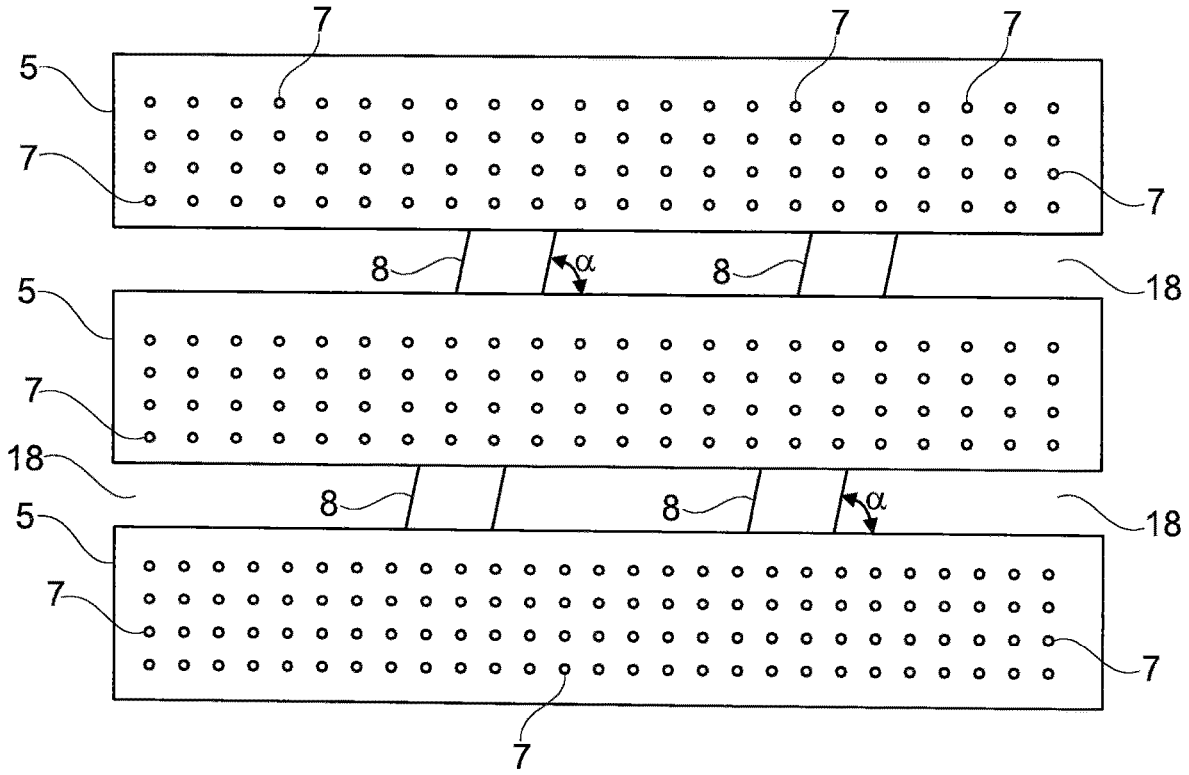
FIG. 7 is a schematic representation of some of the nozzle boxes as seen from the direction of the outer surface of the Yankee drying cylinder.
Figure 8:
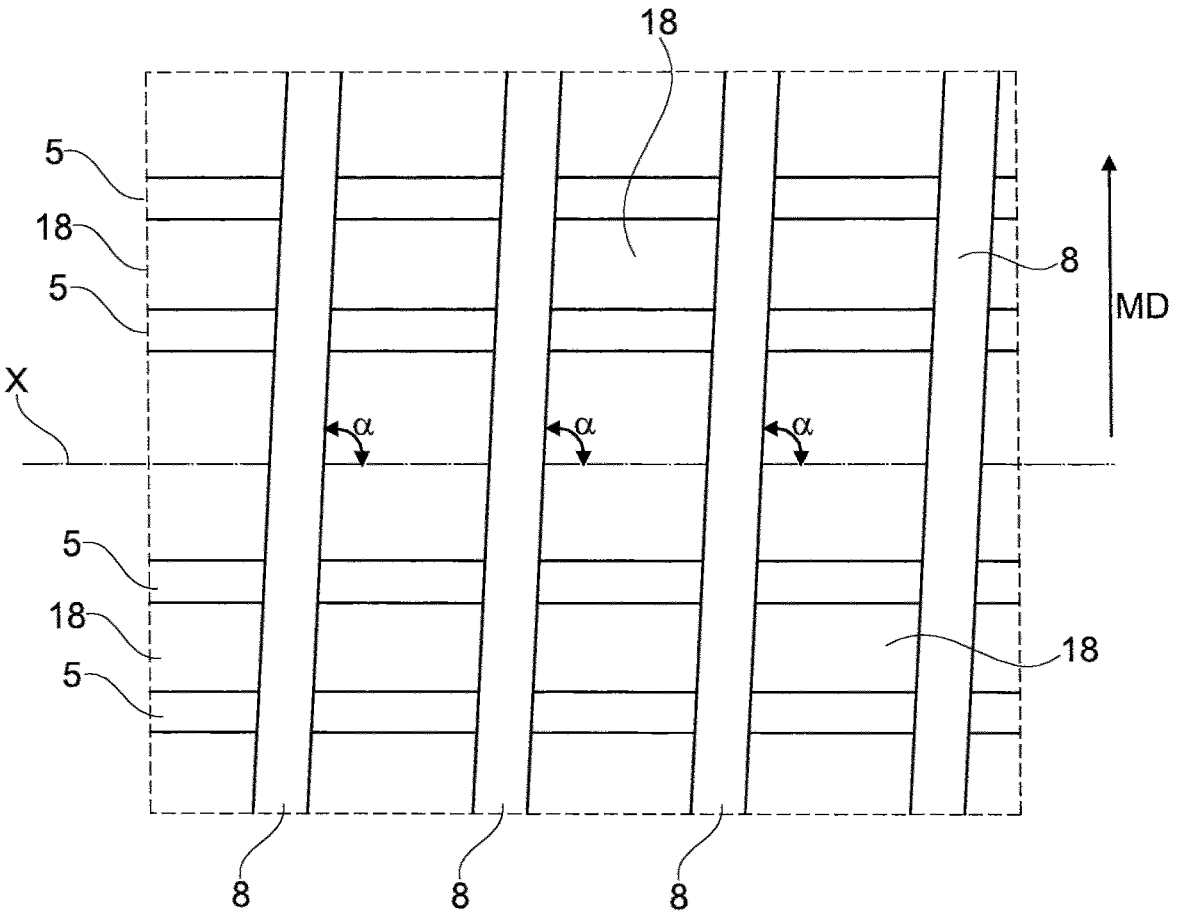
FIG. 8 is a schematic representation of some of the distributor conduits and some of the nozzle boxes as seen in a direction towards the Yankee drying cylinder.
Figure 9:
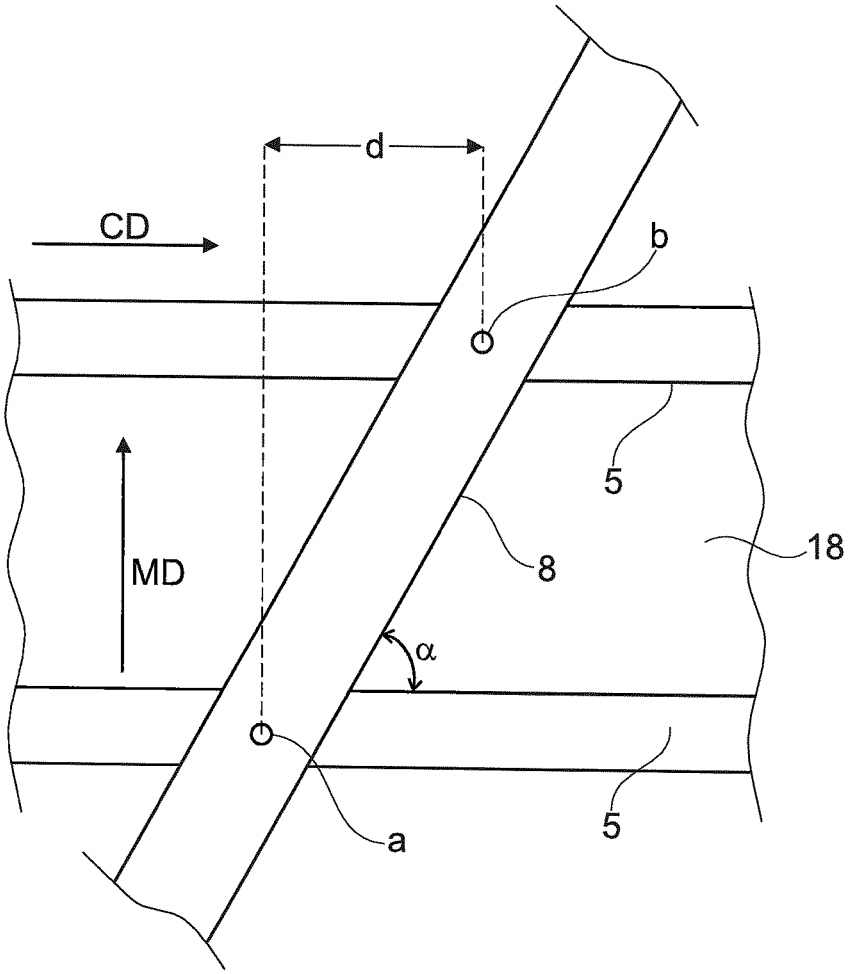
FIG. 9 shows in greater detail some of the parts shown in FIG. 8.

With reference to FIG. 7, FIG. 8 and FIG. 9, the distributor conduits 8 are arranged such that, in the circumferential direction S of the curved structure 6 formed by nozzle boxes 5, the distributor conduits 8 form an angle $\alpha$ with the imaginary axis X around which the nozzle boxes 5 are distributed. The angle $\alpha$ may be the conventional 90° or the distributor conduits 8 may form an angle $\alpha$ which is less than 90° and equal to, or greater than, 60° with the imaginary axis X around which the nozzle boxes 5 are distributed. For example, the distributor conduits 8 may form an angle $\alpha$ which is less than or equal to 87° and equal to or greater than 70° with the imaginary axis X.

The effect of this way of arranging the distributor conduits will now be explained with reference to FIG. 9. In FIG. 9, a distributor conduit 8 is shown that supplies two separate nozzle boxes 5 with a hot fluid F (in particular hot air or some other hot gas). It should be understood that a fibrous web W is travelling in the machine direction MD. At a first nozzle box 5, the distributor conduit 8 supplies the first drying nozzle 5 with hot fluid in the area of the point indicated by "a". Since the distributor conduit 8 is arranged in a helical pattern, it forms an angle $\alpha$ which is less than 90° both with regard to the imaginary axis X around which the nozzle boxes 5 are oriented and also with the nozzle boxes 5 themselves. As a consequence, the distributor conduit 8 will come into communication with the subsequent nozzle box 5 in the area of the point indicated by "b". In the cross-machine direction (the CD direction), the point indicated by "b" is offset by the distance "d" with respect to the point indicated by "a". Therefore, the point along the CD direction at which the hot fluid F enters the nozzle box 5 has been somewhat displaced in relation to where it enters the previous nozzle box 5 (at the point indicated "a"). This means the temperature distribution and heating effect can be evened out to a considerable degree in the CD direction (which is also the direction of the longitudinal extension L of the nozzle boxes 5) since unevenness in the heating effect produced by one nozzle box 5 is compensated for by the heating pattern of the following nozzle box(es) 5.

With reference to FIG. 3 and FIG. 4, the Yankee drying hood arrangement may have more than one first temperature main supply conduit 9 and more than one second temperature main conduit 10. In the embodiment of FIG. 3 and FIG. 4, the Yankee hood drying arrangement has a first pair of first temperature and second temperature main supply conduits 9, 10 and a second pair of first temperature and second temperature main supply conduits 9', 10'. Each pair of first temperature and second temperature main supply conduit 9, 10; 9', 10' is connected to its own set of distributor conduits 8, resp. 8'. The first temperature and second temperature main supply conduits 9, 9', 10, 10' are normally oriented parallel to the imaginary axis X, i.e. perpendicular to the machine direction MD but other orientations of the main supply conduit(s) are conceivable.

With particular reference to FIG. 4, it can be seen that an embodiment is possible in which, in the circumferential direction S (in FIG. 4, the circumferential direction indicated by the arrow S should be understood as being the machine direction, i.e. the direction along which the fibrous web W passes through the machine) of the curved structure 6 formed by the nozzle boxes 5, the Yankee drying hood arrangement is divided into a first part 21 and a second part 22. The first part 21 is here the part where the fibrous web first is exposed to the Yankee drying hood arrangement 1 and the arrow S that indicates the circumferential direction of the curved structure 6 also indicates the direction of travel of the fibrous web W, i.e. it is the machine direction MD. The first part 21 may be referred to as the "wet end" WE of the Yankee drying hood arrangement and the second part 22 may be referred to as the "dry end" (so-called because the fibrous web W contains less water when it reaches the second part 22 than it contained when it first entered the first part 21). The Yankee drying hood arrangement 1 is arranged such that the first part 21 has its own first temperature main supply conduit 9 and second temperature main conduit 10 which are connected via an adjustable dampers 31 to their own set of distributor conduits 8 and drying nozzles 5 while the second part 22 also has its own first temperature main supply conduit 9' and second temperature main conduit 10' which are in fluid communication via adjustable dampers 31' with their own set of distributor conduits 8. Preferably the adjustable dampers 31 and 31' are inlet dampers arranged where fluid from the main supply conduits enter the distribution conduits as shown in the figures, but they may also be arranged inside the distribution conduits. In many practical embodiments, the number of distributor conduits 8 in the first part 21 may be greater than the number of distributor conduits 8' in the second part 22. One reason for this is that it is often desirable to put greater effort into profiling in the first part 21 (i.e. the wet end of the Yankee drying hood arrangement). The dampers are arranged to be individually controlled for controlling the ratio of the fluid flowing from the first temperature and second temperature main conduits to the distributor conduits 8. Preferably they are arranged so that the total flow rate of the fluid entering a distribution conduit from the first and second main conduits remains constant despite changes in the ratio of fluid flowing from the two main conduits. For example, if the first main conduit leading to a distribution conduit provides hot air at a temperature of 500° C. at a flow rate of X cubic metre per second and the second main conduit leading to the same distribution conduit provides hot air at a temperature of 300° C. at the same flow rate of X cubic metre per second, then the mixed fluid in the distribution conduit will have a temperature Tmix of approximately 400° C. (the exact temperature will be dependent on the density of the incoming fluids, which varies with temperature and humidity of the fluid) at a flow rate of 2× cubic metres per second. If the temperature of the fluid in that distribution conduit needs to be lowered, for example if it is detected that the fibrous web leaving the Yankee drying hood arrangement is too dry at the part corresponding to that distribution conduit, then the damper can be adjusted to reduce the flow rate of hot fluid from the first main conduit by an amount Z (i.e. to X−Z) and to increase the flow of cooler fluid from the second main conduit by an equal amount Z (i.e. to X+Z) so that the temperature Tmix falls, thereby reducing the drying effect of the fluid. If the temperature of the fluid in that distribution conduit needs to be raised, for example if it is detected that the fibrous web leaving the Yankee drying hood arrangement is too wet at the part corresponding to that distribution conduit, then the damper can be adjusted to increase the flow rate of hot fluid from the first main conduit by an amount Z (to X+Z) and to decrease the flow of cooler fluid from the second main conduit by an equal amount Z (to X−Z) so that the temperature Tmix rises, thereby increasing the drying effect of the fluid. In this way the drying effect can be varied while the total flow rate remains at 2×, so that the resistance to flow in the system remains substantially constant, and it is not necessary to increase the power supplied to the fans in the system, thereby saving energy.

The reason that the Yankee drying hood arrangement is often divided into two parts 21, 22 (often referred to as "sections") is that the total wrap angle of the Yankee drying hood arrangement (i.e. the part of the circumference of the Yankee drying hood that is covered by the Yankee drying hood arrangement) is very often larger than 180 degrees and it would be impossible or at least very difficult to mount the Yankee drying hood arrangement 1 on the Yankee drying cylinder 2 or to retract the Yankee drying hood arrangement from the Yankee drying cylinder 2 (for example in connection with service, repairs or rebuilds) if the Yankee drying hood arrangement 1 was not divided into two parts (sections) 21, 22. However, it should be understood that embodiments are conceivable in which the wrap angle is so small that the Yankee drying hood arrangement does not need to be divided into two separate parts 21, 22 but could be made as one single part and embodiments designed in one single part are conceivable.

It should also be understood that, even when the Yankee drying hood arrangement is actually divided into two parts 21, 22, the different parts 21, 22 need not necessarily have separate air systems. The air system may be designed as a so-called "duo system" in which each separate part 21, 22 has its own air system (for supply of hot and evacuation of hot fluid F such as hot air) or the air system may be designed as a so called "mono system" which has only one burner (for producing hot air/gas) and one single fan. As an alternative, a Yankee drying hood arrangement with two separate parts may be designed as a "mono system". If the Yankee drying hood arrangement 1 has only one single part (a single part hood), the natural choice would normally be to use a "mono system" since it would be less practical to use a "duo system" in such a case but, in principle, a "duo" system could also be made in one single part. Embodiments are also conceivable in which the Yankee drying hood arrangement is divided into more than two parts that each has its own main supply conduit and its own distributor conduits.

The first part 21 and the second part 22 of the Yankee drying hood arrangement 1 are usually equal in size, i.e. they normally have the same extension in the circumferential direction of the curved structure 6 and the first part 21 normally has the same number of nozzle boxes 5 as the second part. However, embodiments are conceivable in which this is not the case. The exact number of nozzle boxes 5 and their distribution between the first part 21 and the second part 22 (first and second section 21, 22) may vary depending on the machine configuration. The first part 21 and the second part 22 may have the same number of nozzle boxes 5 or it may be so that the number of nozzle boxes 5 is larger in either the first part 21 or in the second part 22.

The first part 21 may be equal in size to the second part 22 but it could also be both larger (longer in the circumferential direction S) or smaller than the second part 22 which may also affect the number of nozzle boxes 5 used in the first and second parts 21 and 22.

Preferably, the Yankee drying hood arrangement 1 comprises a box structure 13 that at least partially encapsulates the nozzle boxes 5, the distributor conduits 8 and the at least one main supply conduit 9, 10. With reference to FIG. 1 and FIG. 4, the box structure 8 may have a roof 17, a back wall 14, a front wall 15 and side walls 16. It should be understood that, with reference to FIG. 1, the back wall 14 is located at the wet end (WE) of the Yankee drying hood arrangement where most of the drying will occur and the front wall 15 is located at the dry end (DE) of the Yankee hood drying arrangement where (in most cases) only a smaller part of the drying effect takes place. The roof 17 may then cover the nozzle boxes 5, the distributor conduits 8,8', and the first and second temperature main conduits 9, 10. Preferably, the roof 17 is curved such that, when the roof faces upwards, water or other liquids that land on the roof 17 will be helped by gravity to flow off the roof 17 and thereby also contribute to cleaning the roof 17 from dust particles Thermally insulating material may be placed between inside the roof 17, for example between a supporting structure for the roof 17 and the roof itself in order to reduce heat losses. Other parts of the box structure may optionally be fitted with heat insulating material.

An example of a nozzle box 5 is shown in perspective in FIG. 12. The nozzle box 5 has a longitudinal extension (length) L which, when the nozzle box 5 is in use, is normally is the extension of the nozzle box 5 in the cross-machine direction CD (see FIG. 2) such that, along its longitudinal extension L, the nozzle box 5 is parallel with the imaginary axis X around which the nozzle boxes are oriented and around which the Yankee drying cylinder 2 rotates. The nozzle box 5 has a height H and a length C in the circumferential direction S of the curved structure 6. In many realistic embodiments of the invention, the nozzle boxes 5 may have a length L in the longitudinal direction of 2.0 m-10 m such that the curved structure 6 formed by the nozzle boxes 5 can cover the cylindrical outer surface 3 of a Yankee drying cylinder 2 having an axial extension of 2.0 m-10 m but other numerical values are also conceivable, even values above 10 m. The height H may be, for example, 10 cm-20 cm but other numerical values are also possible. The length C in the circumferential direction may be, for example, 10 cm-30 cm but other numerical values are also possible. In many realistic embodiments, each nozzle box 5 may comprise 100-300 openings 7 per meter length in the longitudinal direction (L) of the nozzle boxes 5 but other numerical values are also conceivable. For example, it could have 80 openings per meter length or 350 openings per meter length.

The openings 7 in the nozzle boxes 5 may preferably have a circular cylindrical shape but other shapes are also conceivable, for example rectangular or oval. For openings 7 with a circular cylindrical shape, each opening 7 in the nozzle boxes 5 may have a diameter in the range of 2 mm-10 mm, preferably 3 mm-7 mm but other dimensions are also possible and may depend on, for example, the number of openings 7.

With reference to FIG. 6, FIG. 7, FIG. 8 and FIG. 9 there are empty spaces/gaps 18 between the nozzle boxes 5 such that the nozzle boxes 5 are spaced apart from each other in the circumferential direction of the curved structure 6 formed by the nozzle boxes 5. In this way, a fluid such as air or a mixture of air and steam can pass between the nozzle boxes 5. Preferably, the nozzle boxes 5 are spaced from each other by a distance of 30 mm-70 mm in the circumferential direction of the curved structure 6 formed by the nozzle boxes 5. In the circumferential direction of the curved structure 6, the distance between different nozzle boxes is not necessarily the same for all nozzle boxes. For example, in the wet end WE, the distance in the circumferential direction between different nozzle boxes may be smaller than the distance in the dry end DE. It could also be so that, in a part of the wet end WE, the distance is smaller than in the rest of the wet end WE. However, embodiments are also conceivable in which the distance in the circumferential direction of different nozzle boxes is the same for all nozzle boxes.

In the embodiment of the invention shown in FIG. 10 both the wet end and dry end are provided with first temperature and second temperature main conduits (9, 10: 9', 10') and an evacuation conduit 19, 19'. Each evacuation conduit 19, 19' is connected to a source of underpressure which has been symbolically indicated as fans 20, 20' in FIG. 10. When underpressure is applied to the evacuation conduits 19, 19', air or a mixture of air and steam from the Yankee drying hood arrangement can be evacuated and make up air M added. Humid hot exhaust fluid E which has been used to dry the fibrous web can be sucked out between the empty spaces/gaps between the nozzle boxes and evacuated through the evacuation conduits 19, 19'. The temperature Tex of this hot exhaust fluid is less than that in the first temperature main conduit. Temperature Tex could be equal to or lower than 200° C. However, it may be hotter, for example temperature Tex may be equal to or greater than 350° C. and less than or equal to 450° C. To conserve energy some of the humid gas may recirculated to an inlet port 12, 12' for the second temperature main conduit where it can be fed back into the Yankee drying hood. Some heat may be lost from this hot fluid when being recirculated but with good insulation this is minimized and the temperature T2 of the fluid in the second temperature main conduits is substantially the same as, or only a few degrees lower than, the temperature of the exhaust fluid Tex. Additionally, or alternatively, some of the humid gas may be recirculated to an inlet port 14, 14' for the first temperature main conduit 9, 9' where it can be fed back into the Yankee drying hood after being reheated by heater 27, 27'. Optionally, instead of the single fans 20, 20', separate fans (not shown) for the supply of hot fluid F (such as hot air) may be provided together with separate fans 20 for evacuation of a mixture of air and steam. One and the same fan can be used both for supplying hot air (or air to be heated) and for evacuating a mixture of spent hot air and steam.

In the figures the wet end is indicated WE and the dry end is indicated as DE. Normally, it is to be expected that about 60-70% of the evaporation effect takes place in the wet end WE of the Yankee drying hood arrangement (corresponding to the first part 21) and that 30-40% of the evaporation occurs in the dry end DE corresponding to the second part 22 but these values are only given as a rough estimate and may vary depending on operating conditions, machine dimensions and other factors.

Figure 11:
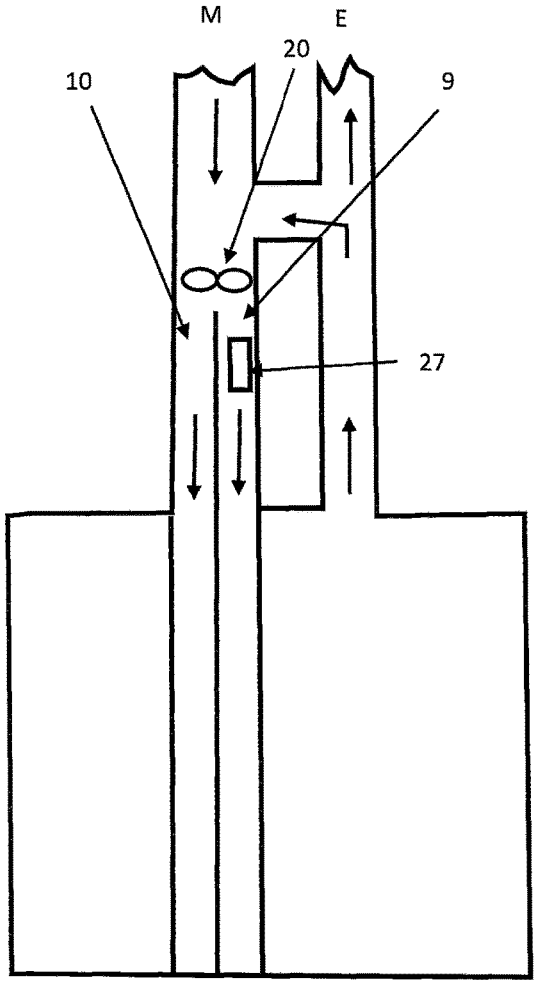
FIG. 11 is a schematic representation of how a fluid such as hot air may exit the nozzle boxes and subsequently be partly evacuated and partly reused in an embodiment of the invention.
Figure 11:
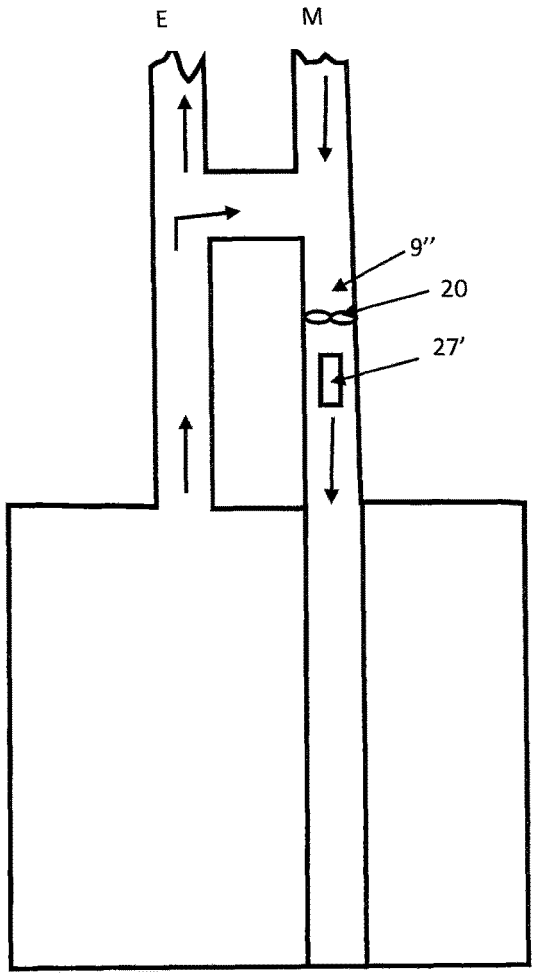

FIG. 11 shows an embodiment of the invention in which only the wet end (WE) has been provided with first temperature and second temperature main conduits 9, 10 which are arranged in a similar fashion to those described above and which have damper means for controlling the temperature of the mixture of fluid entering each distribution conduit. The dry end (DE) has only a single main conduit 9"

which contains fluid which can be a mixture of fresh air and/or make-up air and/or recycled fluid from the Yankee hood which may be heated by a burner 27.

It should be understood that the invention can also be defined in terms of a Yankee drying cylinder 2 which has been fitted with a Yankee drying hood arrangement as described above and wherein the Yankee drying cylinder 2 is rotatably journaled in the bearings 24 such that it can rotate about an axis of rotation X which coincides with the imaginary axis X around which the nozzle boxes 5 are distributed such that the nozzle boxes 5 extend along the outer cylindrical surface 3 of the Yankee drying cylinder 2 and can deliver hot fluid (such as hot air or a mixture of air and/or recycled gases and/or combustion gases) towards the outer cylindrical surface 3 of the Yankee drying cylinder 2 along the axial extension A of the Yankee drying cylinder 2.

It should also be understood that, while the invention has been described above in terms of a Yankee drying hood arrangement and a Yankee drying cylinder, the invention may also be defined in terms of a method of operating such an arrangement and such a Yankee drying cylinder and such a method would include feeding a wet fibrous web to the circular cylindrical surface of the Yankee drying cylinder and performing the steps that would be the inevitable result of operating the arrangement and the Yankee drying cylinder in the way described above.

The invention can thus be defined as a method of drying a fibrous web W on a Yankee drying cylinder 2 which Yankee drying cylinder has an axial extension A and a circular cylindrical surface 3. As explained above the Yankee drying cylinder is rotatably journaled such that it can rotate about an axis of rotation X and the Yankee drying cylinder 2 cooperates with a Yankee drying hood arrangement 1 which is fitted over the Yankee drying cylinder such that the Yankee drying hood arrangement 1 covers a part 4 of the circular cylindrical surface 3 of the Yankee drying cylinder 2. As previously explained, the Yankee drying hood arrangement 1 comprises a plurality of nozzle boxes 5 distributed around the axis of rotation X of the Yankee drying cylinder 2 such that, when the Yankee drying hood arrangement 1 is fitted over the Yankee drying cylinder 2, the nozzle boxes 5 are spaced from the circular cylindrical surface 3 of the Yankee drying cylinder 2 but form a curved structure 6 that follows the outer contour of the circular cylindrical surface 3 of the Yankee drying cylinder 2. Each nozzle box 5 has a longitudinal extension in a direction parallel to the axial extension A of the Yankee drying cylinder 2 and each nozzle box 5 has a plurality of openings 7 distributed along the longitudinal extension of the nozzle box 5. Through the openings 7, a fluid such as hot air, supplied to the nozzle box from first temperature and second temperature main conduits via a distribution conduit can exit the nozzle boxes 5 and stream towards the circular cylindrical surface 3 of the Yankee drying cylinder 2 at different points along the longitudinal extension of each nozzle box 5. In this way, the fluid streaming from the openings 7 can reach the circular cylindrical surface 3 of the Yankee cylinder 2 and the fibrous web W that travels on the circular cylindrical surface 3. During drying of the fibrous web W, hot fluid F is supplied to each nozzle box 5 at different points along the longitudinal extension of the nozzle box 5 such that hot fluid delivered to the nozzle boxes 5 can stream from the nozzle boxes 5 towards the cylindrical surface 3 and the fibrous web W. In a method in accordance with the present invention, one or more distribution conduits in a Yankee drying hood arrangement are each provided with a damper by means of which the ratio of the flow of fluid supplied at a first temperature T1 to the flow of fluid supplied at a second temperature T2 to the respective distribution conduit can be varied, in order to change the temperature of the resulting mixed fluid entering nozzle boxes connected to the one or more distribution conduits. During use of the Yankee drying hood arrangement the dryness of portions of the web dried by the nozzle box(es) connected to the one of more distribution conduits provided with a damper is measured and the temperature of the fluid entering nozzle boxes connected to the one or more distribution conduits is adjusted to means of the damper to achieve a desired dryness of the portions of the web dried by the respective nozzle boxes. In a method in accordance with the present invention, the proportion of fluid supplied at the first temperature is decreased if the measured portion of the web is too dry and the proportion of fluid supplied at the first temperature is increased if the measured portion of the web is too wet. It should be understood that the categories "Yankee drying hood arrangement", "Yankee Drying cylinder and "method of drying a fibrous web" only reflect different aspects of one and the same invention.

Thanks to the invention, a fibrous web can be produced that has a more uniform dryness in the cross-machine direction when it leaves the Yankee drying cylinder, i.e. a more even moisture profile.

The invention claimed is:

1. A Yankee drying hood arrangement (1) which is shaped to be fitted over a rotatable Yankee drying cylinder (2) having an axial extension (A) and a circular cylindrical surface (3) such that the Yankee drying hood arrangement (1) covers a part (4) of the circular cylindrical surface (3) of the Yankee drying cylinder (2), the Yankee drying hood arrangement (1) comprising:

a plurality of nozzle boxes (5) distributed around an imaginary axis (X) which is coincident, or substantially coincident, to the axis of rotation of the Yankee cylinder, such that, when the Yankee drying hood arrangement (1) is fitted over a Yankee drying cylinder (2), the nozzle boxes (5) are spaced from the circular cylindrical surface (3) of the Yankee drying cylinder (2) and form a curved structure (6) that follows the outer contour of the circular cylindrical surface (3) of the Yankee drying cylinder (2), each nozzle box (5) having a longitudinal extension in a direction parallel to the axial extension (A) of the Yankee drying cylinder (2) and each nozzle box (5) having a plurality of openings (7) distributed along the longitudinal extension of the nozzle box (5) through which openings (7) a fluid such as hot air can exit the nozzle boxes (5) and stream towards the circular cylindrical surface (3) of the Yankee drying cylinder (2) at different points along the longitudinal extension of each nozzle box (5) such that the fluid streaming from the openings (7) reaches the circular cylindrical surface (3) of the Yankee drying cylinder (2) at different points along the axial extension of the Yankee drying cylinder (2);

a plurality of distributor conduits (8) for a fluid such as hot air, the distributor conduits (8) extending in the circumferential direction around the curved structure (6) formed by the nozzle boxes (5) and each distributor conduit (8) being in communication with one or more nozzle boxes (5) such that a fluid such as hot air streams from each distributor conduit (8) to said one or more nozzle boxes (5);

at least one first temperature main supply conduit (9) for a fluid including one or more of hot air, hot air and steam, or water vapor, at a first temperature T1, and at least one second temperature main supply conduit (10) for a fluid including one or more of hot air, hot air and steam, or water vapor, at a second temperature T2 which is not the same as T1, said first temperature and second temperature main supply conduits (9, 10) being in communication with the distributor conduits (8) such that fluids from the first temperature and second temperature main supply conduits (9, 10) flow into the distributor conduits (8) and be mixed, wherein at least one distributor conduit (8) is provided with damper means (31) for changing the ratio between the flow rate of fluid at temperature T1 from the first temperature main conduit and the flow rate of fluid at temperature T2 from the second temperature main conduit into said at least one distributor conduit (8).

2. The Yankee drying hood arrangement (1) according to claim 1, wherein temperature T1 is equal to or greater than 250° C. and less than or equal to 700° C.

3. The Yankee drying hood arrangement (1) according to claim 1, wherein, temperature T2 is equal to or greater than 200° C. and less than or equal to 650° C.

4. The Yankee drying hood arrangement (1) according to claim 1, wherein the temperature difference between T1 and T2 is equal to or greater than 100° C.

5. The Yankee drying hood arrangement (1) according to claim 1, wherein the temperature difference between T1 and T2 is equal to or greater than 500° C.

6. The Yankee drying hood arrangement (1) according to claim 1, wherein the nozzle boxes (5) are spaced apart from each other in the circumferential direction of the curved structure (6) formed by the nozzle boxes (5) such that a fluid such as air or a mixture of air and steam pass between the nozzle boxes (5).

7. The Yankee drying hood arrangement (1) according to claim 6, wherein an evacuation conduit (19) is arranged to evacuate exhaust fluid, such as air or a mixture of air and steam and/or water vapor, from the Yankee drying hood arrangement and wherein the evacuation conduit (19) is in fluid connection with an inlet to a second temperature main supply conduit (10).

8. The Yankee drying hood arrangement (1) according to claim 7, wherein the evacuation conduit (19) is in fluid connection with an inlet to the first temperature main supply conduit or conduits.

9. The Yankee drying hood arrangement (1) according to claim 7, wherein the evacuation conduit is in fluid connection with an exhaust conduit leading to one or more of an atmosphere or a heat recover system.

10. The Yankee drying hood arrangement (1) according to claim 7, wherein the evacuation conduit is provided with flow regulating means for regulation the proportion of exhaust fluid which is inputted into each conduit.

11. The Yankee drying hood arrangement according to claim 6, wherein the nozzle boxes (5) are spaced from each other by a distance of 30 mm-70 mm in the circumferential direction of the curved structure (6) formed by the nozzle boxes (5).

12. The Yankee drying hood arrangement according to claim 1, wherein said damper means is a flap or plate configured to change the ratio between the flow rate of fluid at temperature T1 from the first temperature main conduit and the flow rate of fluid at temperature T2 from the second temperature main conduit that streams into the distributor conduit.

13. The Yankee drying hood arrangement according to claim 12, wherein said damper means is configured to change the ratio between the flow rate of fluid at temperature T1 from the first temperature main conduit and the flow rate of fluid at temperature T2 from the second temperature main conduit that streams into the distributor conduit without changing the total flow rate though the distributor channel.

14. The Yankee drying hood arrangement according to claim 1, wherein the nozzle boxes (5) are equidistantly distributed around the imaginary axis (X).

15. A Yankee drying cylinder comprising a Yankee drying hood according to claim 1.

16. A method of drying a fibrous web (W) on a Yankee drying cylinder comprising a Yankee drying hood in accordance to claim 1, the method comprising the steps of:

measuring the moisture content of a fibrous web at at least one position, determining the moisture content for a measured position relative to a predetermined acceptable value and, when the moisture content for a measured position is below the predetermined acceptable value, reducing the flow rate of fluid at temperature T1 and increasing by a corresponding amount the flow rate of fluid at temperature T2 entering the distribution conduit in fluid connection with a nozzle box corresponding to that measured position; and when the moisture content for a measured position is above the predetermined acceptable value, increasing the flow rate of fluid at temperature T1 and decreasing by a corresponding amount the flow of fluid at temperature T2 entering the distribution conduit in fluid connection with a nozzle corresponding to that measured position.

* * * * *